US006775856B2

(12) United States Patent
Ollinger

(10) Patent No.: US 6,775,856 B2
(45) **Date of Patent: *Aug. 17, 2004**

(54) TOILET BOWL PUMP APPARATUS, AND METHOD OF REDUCING THE WATER LEVEL IN A TOILET BOWL

(76) Inventor: Leslie A. Ollinger, 801 Penrose St., Grinnell, IA (US) 50112

( * ) Notice: Subject to any disclaimer, the term of this patent is extended or adjusted under 35 U.S.C. 154(b) by 0 days.

This patent is subject to a terminal disclaimer.

(21) Appl. No.: 10/330,362

(22) Filed: Dec. 30, 2002

(65) Prior Publication Data

US 2003/0088909 A1 May 15, 2003

Related U.S. Application Data

(63) Continuation-in-part of application No. 09/631,112, filed on Aug. 2, 2000, now Pat. No. 6,499,151.

(51) Int. Cl.[7] ..... E03D 9/00
(52) U.S. Cl. ..... 4/255.02
(58) Field of Search ..... 4/255.01, 255.02, 4/255.03, 255.11; 417/487, 490, 511, 514, 550, 555.1

(56) References Cited

U.S. PATENT DOCUMENTS 2,697,842 A * 12/1954 Meyer ..... 4/255.02
5,199,114 A * 4/1993 Christopher ..... 4/255.02

* cited by examiner

*Primary Examiner*—Charles E. Phillips
(74) *Attorney, Agent, or Firm*—Law Offices of William L. Kilma, PC

(57) ABSTRACT

A toilet bowl pump apparatus and method for reducing the water level in a toilet bowl.

17 Claims, 4 Drawing Sheets

26
24
30
32
12b
12
18
20
14
28
22
12a
10
16
12b
12
18
14
28
12
10
40
42
14
44

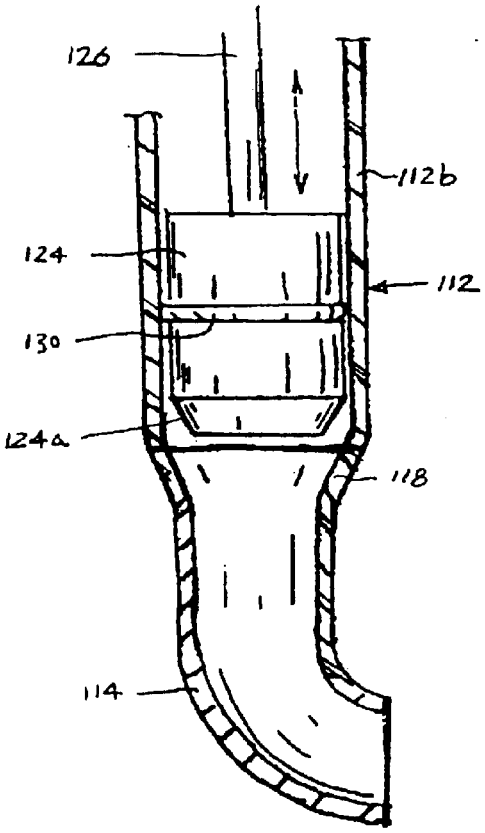
FIG. 7
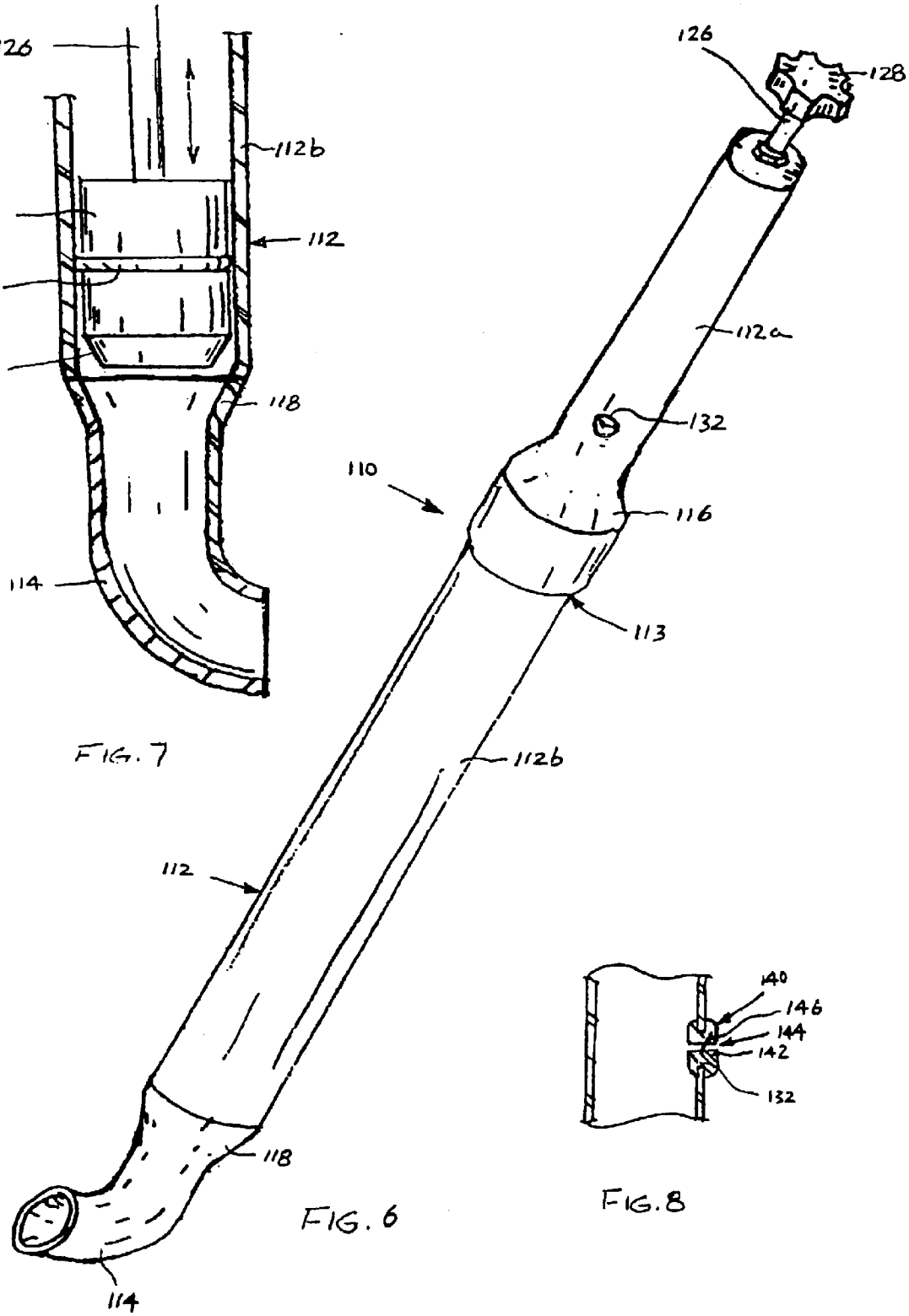
FIG. 6
FIG. 8

TOILET BOWL PUMP APPARATUS, AND METHOD OF REDUCING THE WATER LEVEL IN A TOILET BOWL

RELATED APPLICATION

This is a continuation-in-part of U.S. Patent Application entitled "Toilet Bowl Pump Apparatus, And Method Of Reducing The Water Level In A Toilet Bowl", application Ser. No. 09/631,112, filed Aug. 2, 2000, now U.S. Pat. No. 6,499,151, fully incorporated by reference herein.

FIELD OF THE INVENTION

A toilet bowl pump apparatus and method of reducing the water level in a toilet bowl.

BACKGROUND OF THE INVENTION

In the field of sanitary cleaning and maintenance of toilets, the application of chemical cleaner/disinfectant requires the lowering the water level in the toilet bowls. Specifically, it is desirable to lower the water level in the toilet bowl so that the cleaner/disinfectant can operate at full strength on all surfaces located above and normally below the normal water level. If the water level in the toilet bowl is not lowered, the cleaner/disinfectant is diluted by the water contained in the toilet bowl, and then the cleaner/disinfectant concentration is reduced below a level at which it is effective for both cleaning and disinfectant purposes.

It is current practice to wet mop out a toilet bowl with a device configured like a large cotton swab. This device is configured to enter and clean the toilet bowl drain while forcing water down the toilet bowl drain. A person operating such an existing device must repeatedly plunge the toilet bowl drain for approximately three to five minutes to reduce the water level in the toilet bowl to a sufficient extent necessary for properly cleaning and disinfecting the toilet bowl. Specifically, the water level is preferably reduced at or below the height of the toilet bowl drain.

The existing cleaning operation is time consuming and places the person cleaning the toilet in close proximity therewith making the job a dirty and undesirable job.

Thus, there exists a need for an apparatus and method for reducing the amount of time to reduce the water level in a toilet bowl, and making the job easier, more convenient, and more sanitary for the person cleaning toilets.

SUMMARY OF THE INVENTION

An object of the invention is to provide an improved apparatus for reducing the water level in a toilet bowl.

A second object of the present invention is to provide a toilet bowl pump apparatus for suctioning water from a toilet bowl then forcing the water back into the toilet bowl to cause a siphoning effect through the toilet bowl drain reducing the original water level in the toilet bowl for chemically cleaning/disinfecting the toilet bowl.

A third object of the present invention is to provide a toilet bowl pump apparatus including a cylindrical-shaped cylinder with a piston slidably disposed therein.

A fourth object of the present invention is to provide a toilet bowl pump apparatus including a cylindrical-shaped cylinder with a piston slidably disposed therein with an elbow for diverting the water towards the toilet bowl drain.

A fifth object of the present invention is to provide a method of reducing the water level in a toilet bowl including the steps of suctioning the water from a toilet bowl above a normal or existing water level in the toilet bowl, and then forcing the water back into the toilet bowl to create a siphoning effect through the toilet bowl drain causing the water level to be reduced below the existing water level for chemically cleaning/disinfecting the toilet bowl.

The present invention is directed to an apparatus configured to reduce the water level in a toilet bowl for chemical cleaning and disinfecting purposes. The apparatus is preferably a manually operated pump apparatus configured to suction water from the toilet bowl and then subsequently force the water back into the toilet bowl so as to create a siphoning effect through the toilet bowl drain. Alternatively, the device can be configured with a manual or electrically driven pump configured for suctioning the water out of the toilet bowl into the apparatus above an existing water level in the toilet bowl, and then subsequently forcing the water back into the toilet bowl causing the water to be siphoned from the toilet bowl through the toilet bowl drain.

In a preferred embodiment, the apparatus is a manual hand operated toilet bowl pump configured to suction the water from the toilet bowl to a height above the normal or existing water level in the toilet bowl, and then force the water downwardly into the toilet bowl to create a siphoning effect causing the water to flow into the toilet bowl drain and reduce the normal or existing water level in the toilet bowl to allow cleaning and disinfecting of the toilet bowl with a chemical application.

In a preferred embodiment, the apparatus includes a cylindrical-shaped housing with a piston slidably disposed therein. The apparatus is configured so that a user can grab a handgrip connected to an upper end of a piston rod connected to a piston with one hand. The user can then grip the housing with the other hand. When the piston rod is raised manually by the user, the piston creates a suction force to draw water from the toilet bowl into the housing.

In a preferred embodiment, a lower end of the housing is provided with an elbow for diverting the water from a substantially vertical direction to a substantially horizontal direction directed towards the toilet bowl drain. When the water is forced from the apparatus by the user pushing downwardly on the piston rod, the water is forced from the housing along the elbow and diverted towards the toilet bowl drain. The water diverted towards the toilet bowl drain creates flow through the toilet bowl drain creating a siphoning effect that continues to drain water from the toilet bowl through the toilet bowl drain lowering the normal or existing water level in the toilet bowl.

The apparatus can be provided with a vent configured to vent air located above the piston within the housing of the apparatus. The air vented in this manner allows the piston to be raised within the housing and prevents any resistance due to the air above the piston compressing within the housing and acting like a spring. The vent, for example, can be provided by making a vent hole through the housing at a position above the piston. Alternatively, an air passageway or conduit can be provided in the housing to vent the air located above the piston.

Alternatively, the apparatus can be purposely configured without an air vent so that when the piston is raised an air spring is generated by the trapped air located above the piston within the housing. This air spring can facilitate forcing the water from the apparatus as a user releases the upward force on the hand grip of the piston rod and begins to push downwardly to expel the water from the apparatus.

As a further alternative, the apparatus can be purposely configured without an air vent so that when the piston is lowered a suction force (i.e. air expansion) is generated above the piston (like a reverse air spring) prior to suctioning water from the toilet bowl. When the downward force on the piston rod is released by the user, this reverse air spring pulls up on the piston to facilitate suctioning water from the toilet bowl as the user lifts up on the hand grip connected to the upper end of the piston rod.

In addition or alternatively to an air vent, the housing can be provided with a one-way valve, flow resistance valve and/or a selectively controllable air valve to vent air located above and/or below the piston within the housing to create other effects or modes of operation of the apparatus. Further, air pressure and/or vacuum can be provided selectively to one or both sides of the piston by a selectively controllable air source (e.g. compressed air can, air compressor and air lines) to air assist or control operation of the apparatus.

The apparatus can be made of various materials including metal, plastic, fiberglass, plastic composite. The apparatus can be made from multiple components assembled together. For example, the apparatus can be made from polyvinyl chloride (PVC) plastic components (e.g. pipe sections, reducers, elbow) and glued together with PVC glue. Alternatively, one or more components can be made by plastic injection molding, and then assembled together. In most embodiment, there will exist some assembly required to install the moveable piston and piston rod.

BRIEF DESCRIPTION OF THE DRAWINGS

FIG. 6 is a perspective view of another embodiment of the toilet bowl pump apparatus according to the present invention.

FIG. 7 is a broken away vertical centered cross-sectional view of the lower end of the toilet bowl pump apparatus shown in FIG. 6.

FIG. 8 is a broken away detail cross-section view of the housing provided with an air valve.

DETAILED DESCRIPTION OF THE PREFERRED EMBODIMENTS

Figures 1, 2, 3:
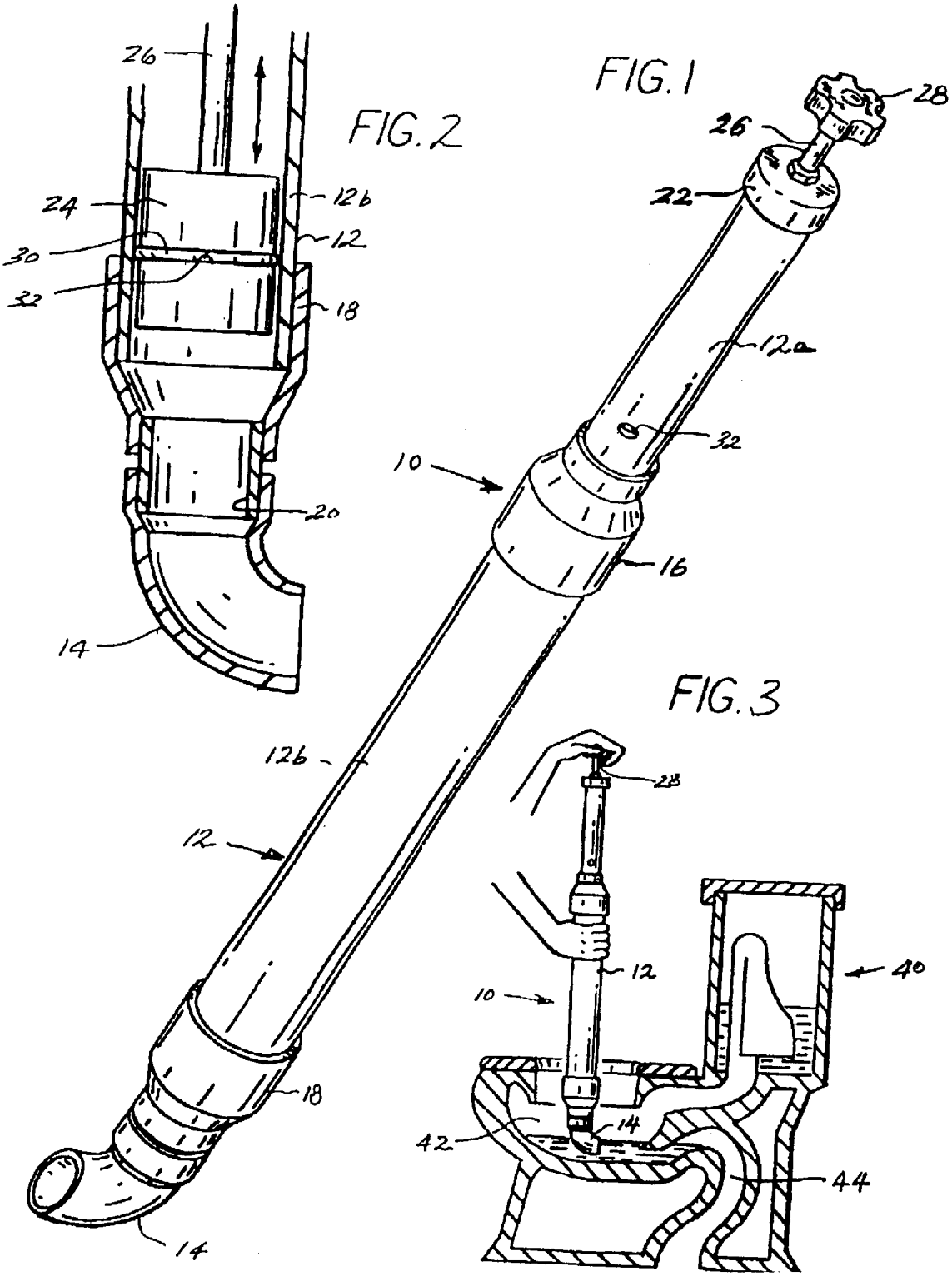
FIG. 1 is a perspective view of a preferred toilet bowl pump apparatus according to the present invention.
FIG. 2 is a partial broken away vertical mid cross-sectional view of a lower end of the toilet bowl pump apparatus according to the present invention.
FIG. 3 is a vertical cross-sectional view of the toilet with the toilet bowl pump apparatus according to the present invention during operation.

A preferred embodiment of a toilet bowl pump apparatus 10 according to the present invention is shown in FIGS. 1 and 2.

The toilet bowl pump apparatus 10 includes a housing 12 provided with a smaller diameter upper housing portion 12*a* and a larger diameter lower housing portion 12*b*. An elbow 14 is provided at a lower portion of the housing 12. A first housing reducer portion 16 connects the upper housing portion 12*a* to the lower housing portion 12*b* and a second housing reducer portion 18 connects the lower housing portion 12*b* to the elbow 14 via the additional tubing portion 20. An end cap 22 is provided at the upper end of the upper housing portion 12*a*.

A cylindrical-shaped piston 24 is slidably disposed within the cylindrical-shaped lower housing portion 12*b* of the housing 12. The piston 24 is connected to the lower end of piston rod 26 and a handgrip 28 is connected to an upper end of the piston rod 26. The piston rod 26 is slidably disposed through the end cap 22. In a preferred embodiment, the piston 24 is provided with an O-ring 30. Specifically, the piston is provided with a peripheral groove 32 for accommodating the O-ring 30. The upper housing section 12*a* is provided with an air vent 32 to allow air to escape when the piston 24 is drawn upwardly within the housing 12, and allow air to enter the upper housing section 12*a* when the piston 24 is forced downwardly.

The toilet bowl pump apparatus 10 is preferably configured with sufficient interior volume to suction into the apparatus 10 a substantial portion of the water contained in the toilet bowl. For example, the toilet bowl pump apparatus 10 is preferably configured to lower the water level at or below the height $H_D$ (FIG. 5) of the toilet bowl drain 44.

The volumetric capacity of the toilet bowl apparatus 10 for a single stroke of the piston 24 is dictated by the diameter of the piston 24 times the stroke length of the piston 24. Thus, the size of the diameter of the piston 24 and the stroke length of the piston 24 are preferably selected to provide a volumetric capacity sufficient to suction a substantial portion of the water contained in the toilet bowl 42.

Another preferred embodiment of a toilet bowl apparatus 110 according to the present invention is shown in FIGS. 6 and 7.

The toilet bowl pump apparatus 110 includes a housing 112 provided with a smaller diameter upper housing portion 112*a* and a larger diameter lower housing portion 112*b*. An elbow 114 is provided at a lower portion of the housing 112. A first housing reducer portion 116 connects the upper housing portion 112*a* to the lower housing portion 112*b*, and a second housing reducer portion 118 connects the lower housing portion 112*b* to the elbow 114.

A cylindrical-shaped piston 124 is slidably disposed within the cylindrical-shaped lower housing portion 112*b* of the housing 112. The piston 124 is connected to the lower end of piston rod 126 and a handgrip 128 is connected to an upper end of the piston rod 126. The piston rod 126 is slidably disposed through the end of the upper housing portion 112*a*. In a preferred embodiment, the piston 124 is provided with an O-ring 130. Specifically, the piston 124 is provided with a peripheral groove 132 for accommodating the O-ring 130. The upper housing portion 112*a* is provided with an air vent 132 to allow air to escape when the piston 124 is drawn upwardly within the housing 112, and allow air to enter the upper housing portion 112*a* when the piston 24 is forced downwardly. Alternatively, in some embodiments the air vent 132 can be eliminated or provided with a one (1) way air valve or a selectively controllable air valve to provide various effects or different modes of operation of the apparatus 110.

The elbow 114 and second housing reducer portion 118 can be made as a single piece as shown in FIG. 6. This assembly is connected to the lower end of the lower housing portion 112*b*, preferably in a substantially seamless manner as shown to eliminate any flow resistance. Alternatively, the elbow 114, second housing reducer portion 118 and lower housing portion 112*b* can be made as a single piece (e.g. by plastic injection molding) to reduce the number of pieces and ease of assembly of the apparatus 110.

The upper housing portion 112*a* and first housing reducer portion 116 can be made as a single piece as shown in FIG. 6. It is to be noted that the end cap 22 in the embodiment shown in FIG. 1 has been incorporated into the upper housing portion 112*a* as a single piece to reduce the number of pieces and ease of assembly of the apparatus 110. The upper housing portion 112*a* is connected to the lower housing portion 112*b* during assembly. The joint 113 allows the piston 124 and piston rod 126 to be assembled together and installed within the housing 112 prior to the assembly of the upper housing portion 112*a* to the lower housing portion 112*b*. The joint 113 can be configured to be substantially permanent (i.e. not subject to disassembly) once assembled, or can be configured to releasably connect the upper housing portion 112*a* to the lower housing portion 112*b* (e.g. twist or threaded connection) to allow inspection, repair and/or replacement of the piston 124 and/or piston rod 126 after extended use.

The piston 124 preferably is provided with an inwardly tapering lower edge 124*a* to conform substantially with the inner surface of the second housing reducer portion 118, as shown in FIG. 7. In this manner, the inner surface of the second housing reducer portion 118 serves as a stop for the piston 124 against further downward movement within the apparatus 110. The tapering configuration softens the stop and reduces the chances for breakage upon contact therebetween.

Alternatively, the apparatus 110 can be provided with an air valve, flow resistor valve and/or a selectively controllable air valve. For example, a one (1) way air valve 140 can be fitted into the air vent 132, as shown in FIG. 8, to allow air to enter the upper housing portion 112*a*, but prevent air from venting out of the upper housing portion 112*a*. In this embodiment air located above the piston 124 will act as an air spring as the piston 124 is raised by the user, however, there will exist little or no resistance on the downward stroke due to air located above the piston 124 then venting into the upper housing portion 112 via the one (1) way air valve 140 as the piston 124 is driven down by the user.

OPERATION

Figure 4:
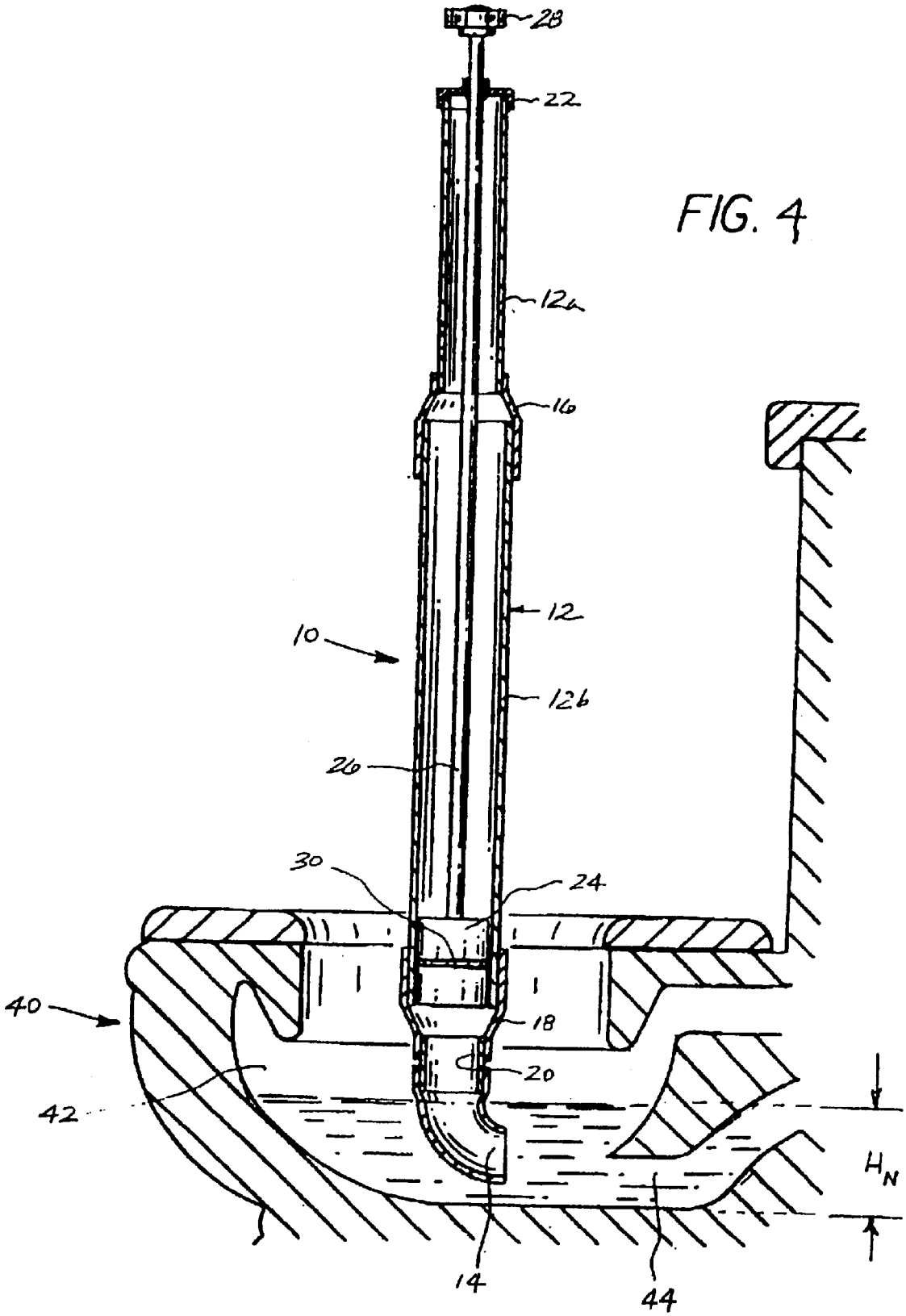
FIG. 4 is a vertical centered cross-sectional view of a toilet bowl pump apparatus shown in FIG. 1 disposed within a toilet bowl in a mode readied to begin suctioning water from the toilet bowl into the toilet bowl pump apparatus.
Figure 5:
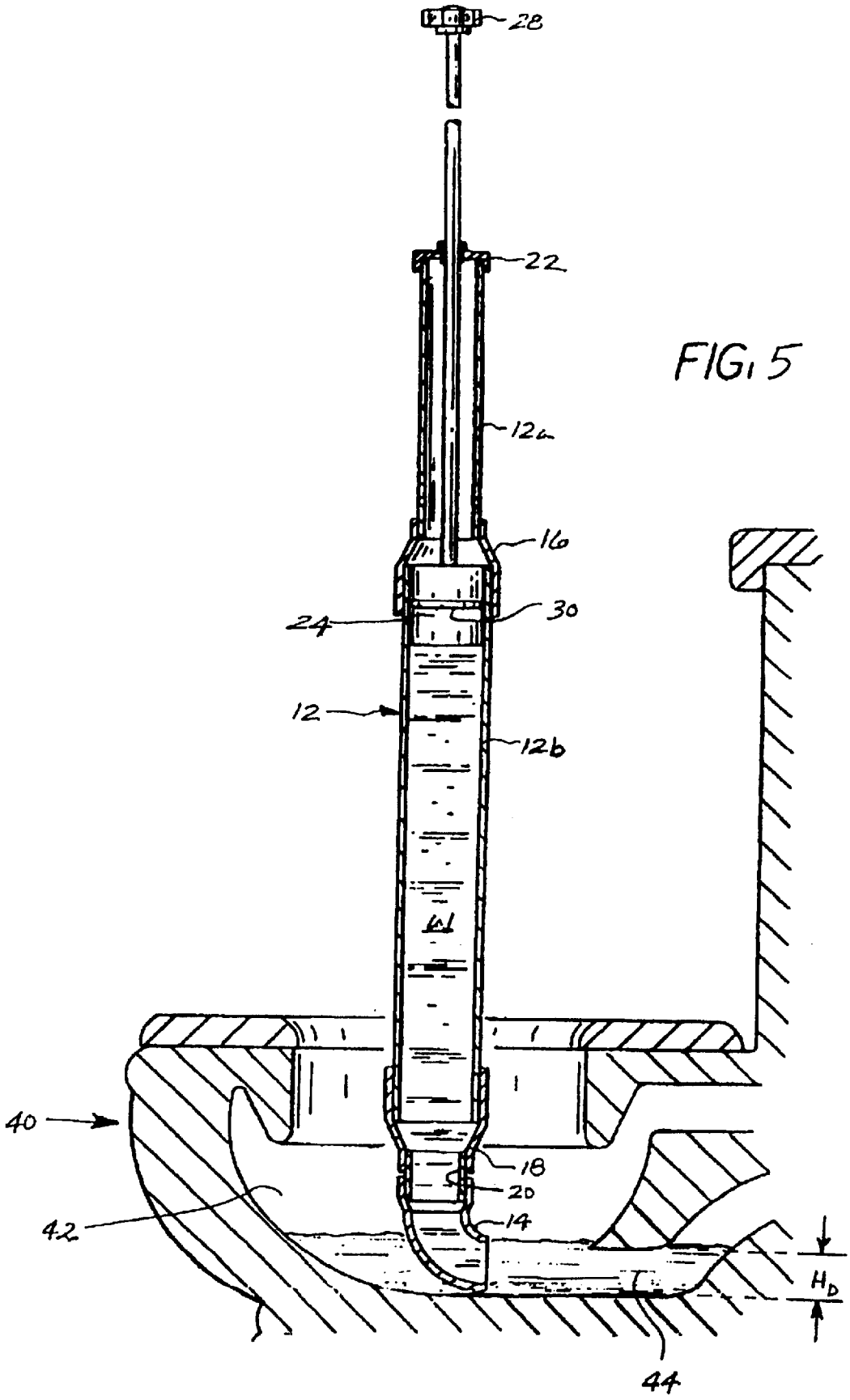
FIG. 5 is a vertical centered cross-sectional view of the toilet bowl pump apparatus shown in FIG. 1 disposed within a toilet bowl in a mode readied to force the water back into the toilet bowl to create a siphoning effect through the toilet bowl drain to reduce the water level in the toilet bowl.

During operation, as shown in FIG. 3, a person grips the housing 12 with one hand and the handgrip 28 with the other hand while orientating the apparatus 10 in a substantially vertical position. The apparatus 10 is lowered into the toilet bowl 42 until the elbow 14 is positioned near the bottom thereof. The apparatus is rotated so that the elbow 14 is oriented so as to divert the flow of water towards the toilet bowl drain 44. FIG. 4 shows the location of the piston 24 prior to operation of the apparatus 10. In use, the user grabs the handgrip 28 and lifts the same while holding the housing 12 stationary with the other hand. This handling causes the piston rod 26 to draw the piston 24 upwardly to begin drawing water through the elbow 14 into the apparatus 10 by hydraulic effect. The user continues to lift the handgrip 28 upward along the full stroke of the piston 24 until it reaches the position shown in FIG. 5. Then, the user forces the handgrip 28 and piston rod 26 downwardly expelling the water under force and diverting the water towards the toilet bowl drain 44. The water diverted toward the toilet bowl drain 44 causes a flow through the toilet bowl drain 44 creating a siphoning effect in the toilet bowl drain that continues to drain the water through the toilet bowl drain 44 and lower the water level from the normal or existing water level. The end result is that the water level is lowered from the normal water level of height $H_N$ (FIG. 4) to the lowered water level height $H_D$ (FIG. 5).

What is claimed is:

1. A toilet bowl pump apparatus configured for lowering a normal water level in the toilet bowl to allow chemical cleaning/disinfecting of the toilet bowl, said apparatus comprising:

a housing including a lower housing portion having a larger transverse cross-sectional size connected to an upper housing portion having a smaller transverse cross-sectional size by a first housing reducer portion;

an elbow flow diverter connected to a lower end of said lower housing portion by a second housing reducer portion, said flow diverter configured for placement with the toilet bowl adjacent to a toilet bowl drain and diverting water contained with said housing towards the toilet bowl drain to create a siphon effect that causes water in the toilet bowl continue to drain through the toilet bowl drain, said lower housing portion, said second housing reducer portion and said flow diverter are configured to be a single piece;

a piston slidably disposed within said lower housing portion;

a piston rod connected to said piston, said piston rod extending through upper end of said upper housing portion; and a hand grip connected to an upper end of said piston rod.

2. An apparatus according to claim 1, including an air vent associated with said apparatus, said air vent configured to vent a space located above said piston within said housing to reduce the resistance against movement upwardly of said piston by a user.

3. An apparatus according to claim 1, wherein said lower housing portion is provided with a cylindrical inner surface and said piston is cylindrical-Shaped and sized to substantially seal with said cylindrical inner surface of said lower housing portion.

4. An apparatus according to claim 3, wherein an outer surface of said lower housing portion is cylindrical-shaped.

5. An apparatus according to claim 1, wherein said upper housing portion is configured to provide a hand grip for a user.

6. An apparatus according to claim 5, wherein an outer surface of said upper housing portion is cylindrical-shaped.

7. An apparatus according to claim 1, wherein said lower housing portion is cylindrical-shaped and said upper housing portion is cylindrical-shaped.

8. An apparatus according to claim 7, wherein said first housing reducer and said second housing reducer are conical-shaped.

9. An apparatus according to claim 1, wherein said first housing reducer and said second housing reducer are separate components assembled together with said lower housing portion and said upper housing portion.

10. An apparatus according to claim 1, wherein said lower housing portion, said first housing reducer portion and said upper housing portion are configured to be a single piece.

11. An apparatus according to claim 1, wherein said apparatus is configured so that a volumetric size of said lower housing portion dictated by said transverse cross-section size times the length of a stoke of said piston are selected to remove substantially all of the water of a toilet bowl during a single stroke of said piston.

12. An apparatus according to claim 1, wherein said elbow flow diverter is configured to be a forty-five degree (45°) to ninety degree (90°) angle elbow.

13. An apparatus according to claim 1, wherein said housing comprises a larger diameter lower housing portion and a smaller diameter upper housing portion.

14. An apparatus according to claim 1, wherein said piston is provided with an O-ring.

15. An apparatus according to claim 14, wherein said piston is provided with an outer circumferential groove for accommodating said O-ring.

16. An apparatus according to claim 1, wherein said housing and elbow are made of plastic.

17. An apparatus according to claim 1, wherein said plastic is polyvinyl chloride (PVC).

* * * * *